US005367746A

United States Patent [19]

Clement et al.

[11] Patent Number: 5,367,746

[45] Date of Patent: Nov. 29, 1994

[54] DRIVE FOR A COMBER

[75] Inventors: Heinz Clement; Hansulrich Eichengerger, both of Winterthur; Oliver Wuest, Seuzach, all of Switzerland

[73] Assignee: Rieter Machine Works, Ltd., Winterthur, Switzerland

[21] Appl. No.: 64,152

[22] PCT Filed: Sep. 18, 1992

[86] PCT No.: PCT/CH92/00190

§ 371 Date: Jun. 18, 1993

§ 102(e) Date: Jun. 18, 1993

[87] PCT Pub. No.: WO93/06275

PCT Pub. Date: Apr. 1, 1993

[30] Foreign Application Priority Data

Sep. 20, 1991 [CH] Switzerland ..... 2801/91-3

[51] Int. Cl.[5] ..... D01G 19/08

[52] U.S. Cl. ..... 19/115 R; 242/563; 242/564.5; 242/595.1

[58] Field of Search ..... 19/115 R, 215, 223; 242/66

[56] References Cited

U.S. PATENT DOCUMENTS 4,496,112 1/1985 Olsson et al. ..... 242/66
4,535,949 8/1985 Olsson ..... 242/66 X
4,817,883 4/1989 Hoffmann et al. ..... 242/66
5,027,475 7/1991 Mondini et al. ..... 19/115 R
5,077,865 1/1992 Mondini et al. ..... 19/115 R
5,095,586 3/1992 Wüst et al. ..... 19/115 R
5,230,125 7/1993 Clement et al. ..... 19/115 R

FOREIGN PATENT DOCUMENTS 0437807 7/1991 European Pat. Off. .
2264900 10/1975 France .
3937989 1/1991 Germany .
3935657 5/1991 Germany ..... 19/115 R
3042923 2/1988 Japan ..... 19/115 R

*Primary Examiner*—Clifford D. Crowder
*Assistant Examiner*—John J. Calvert
*Attorney, Agent, or Firm*—Francis C. Hand

[57] ABSTRACT

One or both of the lap rollers on which a lap roll is mounted for unwinding purposes is driven with an increasing speed during the winding-off interval so as to maintain the thickness of the lap layer constant. This, in turn, maintains the count of the sliver to be formed in the comber at a constant number. The increase in the lap roller drive can be made dependent upon the length of the lap layer which is unwound from the roll, on the mass of the lap layer delivered to the comber or on the mass of a sliver produced from the combed lap as measured at a point downstream of the comber. The speed may be increased in a stepwise manner or continuously.

10 Claims, 3 Drawing Sheets

DRIVE FOR A COMBER

The invention relates to a method for feeding a lap which can be wound off from a lap roll to a combing unit of a comber.

With known combers, as can be seen in CH-PS 625 564 e.g., the lap to be combed out is fed to the comber in the form of a lap roll. During the winding off of the lap, the lap roll is placed on two lap rollers, of which at least one is driven. The winding off of the lap from the lap roll takes place before the front lap roller. The lap wound off in such a manner reaches via a feed roller into the nip of a nipper jaw and is combed out at its front end, which extends past the nipper jaw, with the nipper jaw closed by way of a comb cylinder arranged below the nipper jaw. Following the combing out process, the nipper jaw is opened again and the combed out fiber tuft is transferred to a subsequent detaching roller pair. During this detaching process, a top comb inserted into the fiber tuft to be detached can effect an additional combing effect. During the combing process, the nipper jaw effects a to and fro movement. In order to enable a simpler joining of a new lap, the driven lap roller is disconnected from the drive by a coupling so that both lap arbours are freely turnable.

European Patent Application 03 60 064 describes a comber in which a front lap roller is driven by a separate driving motor which is triggered by a control unit. This control unit has the task to chronologically harmonize the controls of the separate driving motor for the feed rollers, the drive for the lap arbour as well as the drive for the nipper jaw, the comb cylinder and the detaching roller.

The lap roll rests freely on the two lap rollers with its entire weight (20–25 kg). As a result, an indentation is created in the roll in relation to its circumferential diameter based on the elasticity of the lap. After passing the resting place, the lap expands to its original diameter minus the thickness of a lap layer. With a decreasing lap diameter and hence decreasing weight, this indentation depth decreases. In order to ensure a better carrying, the lap rollers are toothed.

The circumferential speed of the lap is greater on its circumferential diameter than the circumferential speed in the area of the least distance between the center axis of the lap and the resting surface i.e. a contact surface roller. This results in that the more the diameter and hence the weight of the lap decreases, the smaller the indentation depth, and hence also the penetration of the lap into the toothing, and the difference between the circumferential speed in the area of its external diameter and the circumferential speed in the area of the least distance between center axis of the lap and the contact surface of the lap roller. Based on these different speed relationships, a different feeding speed of the lap can result depending on the diameter or weight of the lap roll. In addition to the described influence of the changed indentation depth on the supplying speeds of the lap, with decreasing lap weight the changed dynamic interaction between the intermitting drive of the feed roller and the constant drive of the lap roller also influences the changing of the supplying speed during the winding-off process of a lap roller. By way of the mentioned influences, the tension draft of the lap changes between the lap roller and the feed roller during the winding-off process.

From this results, as investigations have shown, that at the beginning of the winding off process, the combing aggregate is fed a thicker lap for combing out than toward the finish of the lap roll.

This deviation is generally termed as drift and may be of up to 5%, depending on the structure of the lap roll, material and other parameters.

A separate drive for the lap rollers, which is controlled by a control device, is also shown in Swiss Application No. 140/90, filed Jan. 17, 1990. The control of the separate drive for the lap rollers is here necessary for the joining process of a new lap in the nipper jaw of the comber. A continuous adjustment of the lap roller drive during the winding off process is not provided here.

These differences emerging during the winding off process of a lap of a mass fed for combing has a negative effect on maintaining the count of a sliver created following the combing aggregates.

The combers are, as a rule, equipped with eight combing heads, each being fed a lap roll for combing out. The lap combed out in this way is then collected to a sliver. This way eight slivers are created which are guided, after corresponding deflection, juxtapositioned to a subsequent drafting arrangement. The slivers drafted in this drafting arrangement are collected into a single sliver which is subsequently placed, as a rule, in a can.

Between the drafting arrangement and the can coiler there is, as e.g. to be taken from the E7/5 of Rieter company, a sliver monitoring device which monitors the count of the exiting sliver.

The drift of up to 5% created during the winding off process of the lap, as previously described, can be measured with this sliver monitoring in a time-delayed manner.

It is therefore the object of the invention to propose a method or a device for the drive of the comber, or of the lap rollers, which enables the formation of an even sliver at the comber and ensures a continuous feed of a lap mass to a combing unit, independent of the size of the lap roll.

Briefly, the invention provides a method of feeding a flap from a lap roll comprising the steps of mounting a roll of lap on a pair of lap rollers, driving at least one of the lap rollers in a direction to unwind a layer of lap from the lap roller during a winding-off integral and increasing the speed of the lap roller during the winding off interval in order to maintain the constant thickness in the lap layer unwound from the lap roll.

The technique employed may change the speed of each of the driven lap rollers or only one lap roller during a winding-off integral.

Here, the expression "winding off interval" refers to the period between the placing of a new and full lap and the winding off of the lap from a tube of the lap roll. The invention is not restricted to both lap rollers being connected to the drive, but applies also to the drive of only one lap rollers with the other lap rollers being carried along by friction via the lap roll.

It is proposed that the speed of the driven lap rollers is increased within the winding-off interval.

In a further embodiment of the invention it is proposed that the lap rollers are driven by an independent drive which can be controlled or adjusted independently from the drive of the combing aggregates.

The term combing aggregates generally is understood to comprise a nipper jaw, feed roller, top comb, comb cylinder and the detaching roller.

By way of the proposed independent control and adjustment, an adaption of the speed increase of the lap rollers during a winding off interval is ensured for different lap feeds. Also, in this way corrections of the speed changes can easily be conducted.

As a rule, the total length of the wound up lap is known from the process of the lap formation which is upstream of the comber. Based on the required supplying speed of the lap to the combing aggregates, a conclusion results concerning the time interval in which the lap is wound off the tube again.

It is therefore proposed to adjust the speed adaption of the lap rollers via the control of the drive according to the measure of the wound off lap length. Here, for the purpose of adapting, various parameters can be used. These parameters can e.g. be experimental or testing values which preset a corresponding adaption of a speed increase. The speed can be increased continuously based on a curve or discontinuously within a certain time interval. A further determination for finding the parameters which serve for adjusting the drive of the lap rollers is a direct detection of the mass of the wound off lap between the front lap roller and a feed roller of a nipper jaw via a capacitive measuring organ. The measuring values hereby determined result in a signal in comparison with the preset value which brings about a readjustment of the drive of the lap roller.

As further proposed, there also exists the possibility to detect the mass of the sliver formed following the combing aggregates via a measuring device. Here the drive of the lap rollers is readjusted in case of a drifting off from a preset value. Here, however, the comber-waste loss must be taken into consideration. A control of the drive of the lap roller by monitoring the lap weight is also conceivable.

It is further proposed to automatically return the drive of the lap rollers back to their beginning speed at a lap roll change. This way, it is ensured that for the processing of each lap roll, the same conditions are created. Via a sensor, as e.g. described in CH-PS 572 529, the winding off of the end of the lap from the tube is monitored. This signal can be used for returning the drive of the lap arbours to its beginning position.

When using an automatic lap joiner for a new lap roll it is necessary to create an overriding possibility of the speed and of the direction of rotation of the lap rollers in relation to the beginning speed.

The proposed method for adapting the speed during the winding off interval is to be applied advantageously when a block change of the lap at the comber is effected. This means that all laps are changed at all eight combing heads simultaneously. This ensures that the diameter decrease during the wind-off of the lap is equal at all combing heads.

It is however also possible to effect the method according to the invention at a comber with a so-called "wild change". The expression "wild change" here refers to the lap rolls being changed singly according to their finishing. For the realization of the method according to the invention, it would be necessary in this case to allocate to each single combing head a separate drive for the lap rollers in order to meet the different finishing of the lap roll of each combing heads.

These and other objects and advantages of the invention will become more apparent from the following detailed description taken in conjunction with the accompany drawings wherein.

Figure 1:
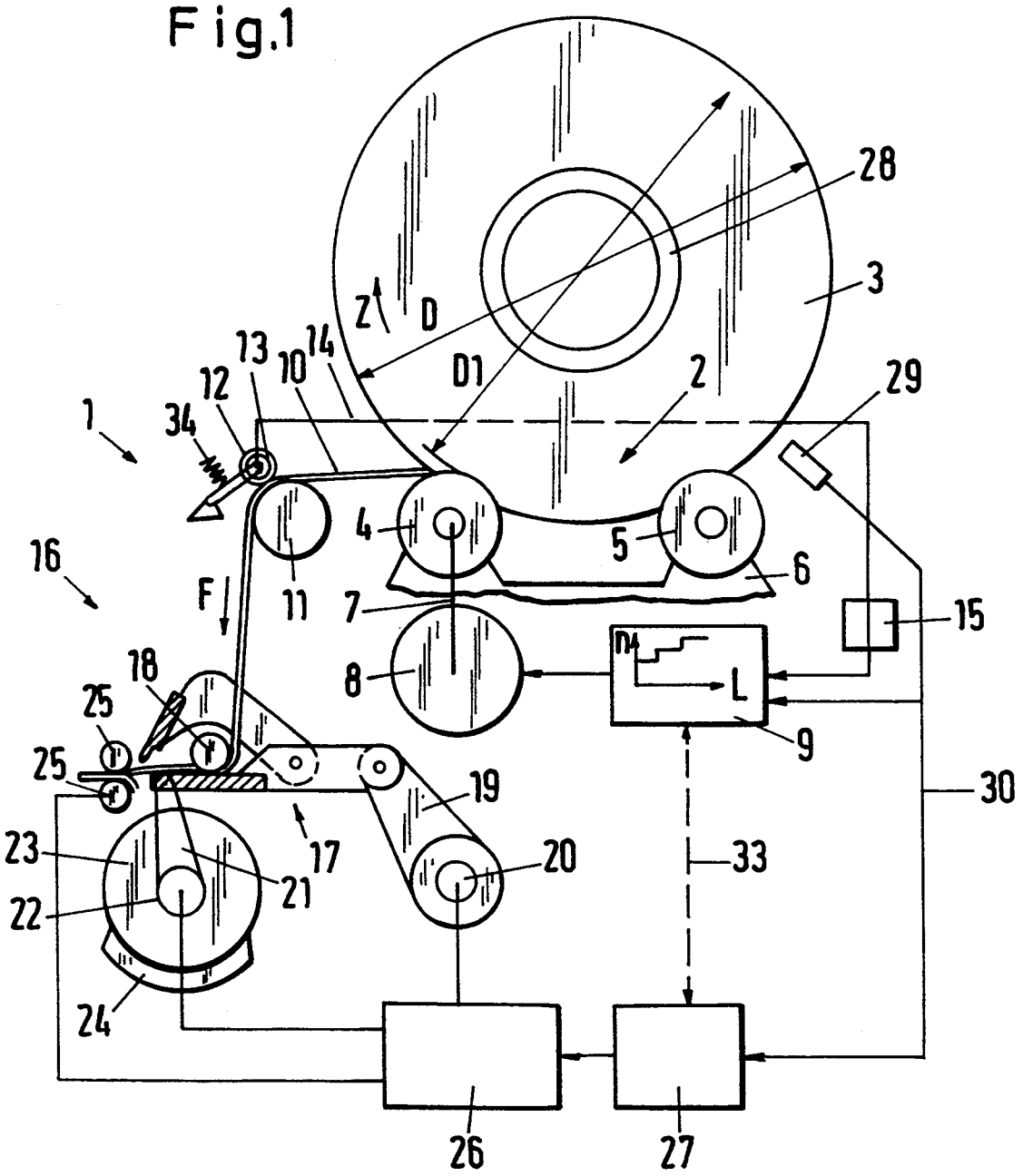
FIG. 1 shows a schematic sideview of a combing head with a control device for the lap rollers.

FIG. 1 shows a combing head 1 in schematic sideview of a comber. Usually, eight such combing heads 1 are installed on a comber. The exemplary embodiment is shown and described on only one combing head for clarity, the listed driving units being used by all combing heads together, however. This is required in particular for combing machines in which a previously described block change takes place. The driving shafts hence extend over the entire width of the combing heads, with the drive taking place centrally from one side of the combing heads. It is however also conceivable to allocate separate driving units or controls to each combing head or to groups of combing heads.

In its upper area the shown combing head 1 is provided with a receptacle 2 for a lap roll 3. The lap roll 3, which below will also be referred to simply as "lap", rests freely on two lap rollers 4 and 5 which are pivoted in a frame 6. Here the front lap roller 4 is connected to a motor 8 via a drive line 7. The motor 8 can also be arranged directly flush with the lap roller 4. Further, it is also conceivable to arrange between motor 8 and lap roller 7 a transmission gearing. This is, however, only of secondary importance and is merely mentioned here. The motor 8, e.g. an electric motor, is controlled via a control unit 9. The lap layer 10 wound off from the lap 3 which rotates in a clockwise direction Z is guided over a guide roller 11, on which a spring weighted feeler roller 12 is placed. An incremental transducer (impulse transmitter) 13 is laterally attached to determine the speed of the roll 12. The signal of this impulse transmitter 13 is transmitted via a path 14 to a controller 15 from which, after conversion of these signals, corresponding control pulses are transmitted to the control unit 9. The lap layer 10 passes down to a combing aggregate 16. This combing aggregate 16 is formed by a nipper jaw 17, in which a feed roller 18 is pivoted. This feed roller 18 is as a rule rotated by a relative movement between the upper and lower nipper jaw via a ratchet drive (not shown). The nipper jaw 17 is pivoted via an articulated arm 21 on a comb cylinder axle 22 of a comb cylinder 23 provided with a combing segment 24. Seen in conveying direction F of the lap layer 10 following the nipper jaw aggregate 17, there are the detaching rollers 25. The drive of the detaching rollers 25 of the comb cylinder 23 and of the driving shaft 20 for the nipper jaw 17 takes place by a central driving unit 26 which is controlled via a control unit 27.

In order to scan the lap 3, or to monitor the finishing of the lap layer 10 from the tube 28, a sensor 29 directed at the tube is attached. The signals produced by sensor 29 upon finishing of the lap are transmitted to the control units 9 and 27 via a path 30.

Figure 2:
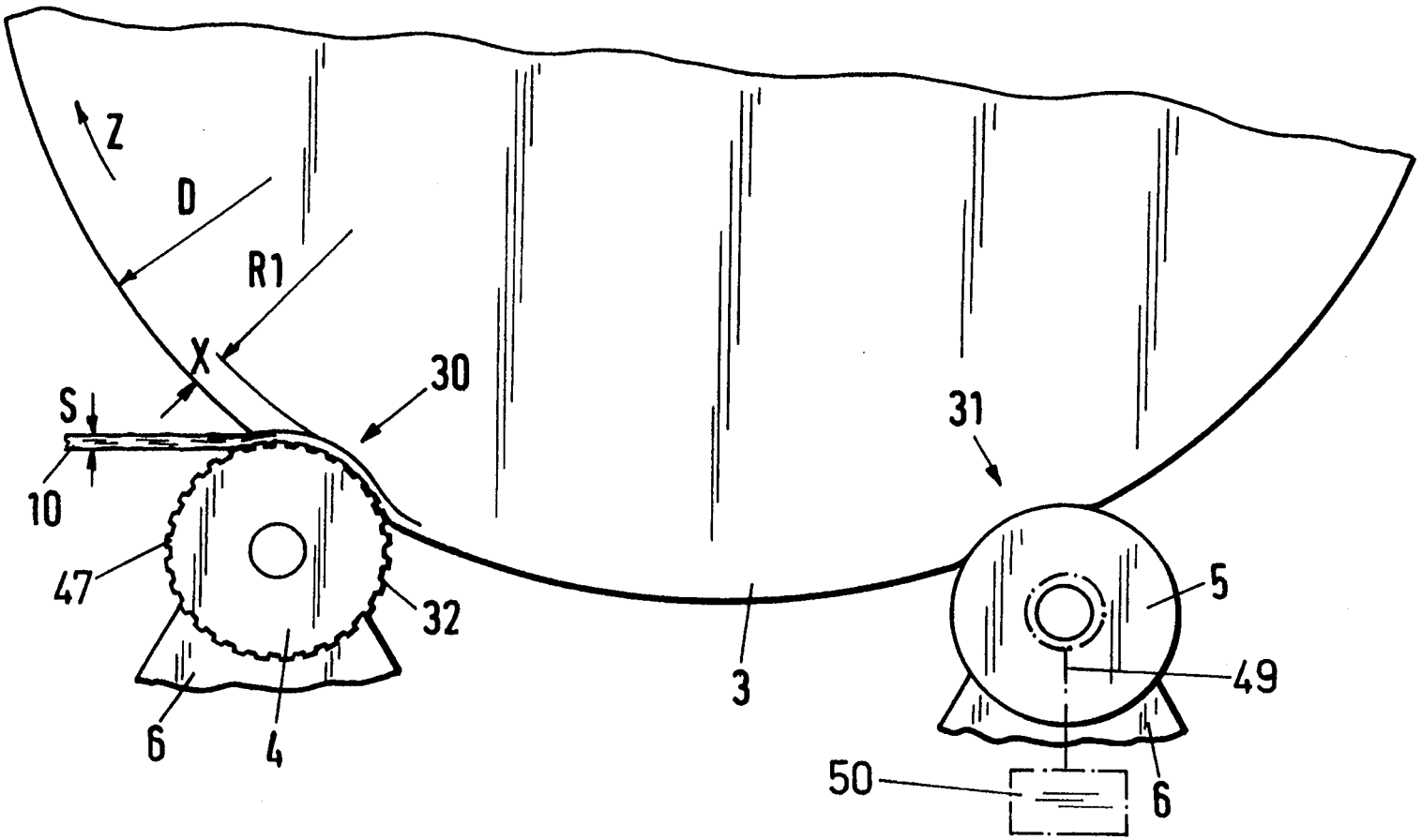
FIG. 2 shows an enlarged partial view according to FIG. 1.

In FIG. 2, the lap 3 as well as the lap rollers 4 and 5 receiving the lap 3 are shown in enlarged representation. In the area of the rest 30 of the lap roller 4 and of the rest 31 of the lap roller 5, the lap is indented in relation to its exterior diameter D. This indentation with the indentation depth is created by the elastic and giving lap structure. The resting area of the exterior circumference 32 of the lap arbour 4 has a minimum distance R1 to the center of the lap 3. In relation to the diameter, $2 \times R1 = D$. After passing the rest 30 the lap roll expands to approximately its original diameter minus the wound off lap layer of the thickness S. As has been hinted at schematically, the driven lap roller 4 is provided with a toothing 47. The rear arbour 5 could also have such a toothing 47. At the lap roller 5, the possibility of a bearing of the roller in a bearing bracket 49, which rests on a balance 50 and hence enables the monitoring of the resting lap weight, is indicated by dash-dots.

With friction via the exterior circumference 32 of the driven lap roller 4, the lap 3 is turned in the winding-off direction Z and the lap layer is wound off behind the rest 30 from the lap 3. Departing from that the transmission of the rotating movement of the lap roller 4 in the area of the rest 30 takes place with the diameter D1, with a diameter D1 in relation to the diameter D a lower circumferential speed is achieved and hence a different feeding speed for the lap 10. On the other hand, the circumferential speed of the lap roller 4 is constant, varying however in the toothing. This means, that with a decreasing lap roll diameter D and hence a decreasing weight of the lap 3, this indentation depth X decreases and the lap roll diameter D approaches the diameter D1 and the lap is pressed less strongly into the toothing 47 of the lap rollers. Hence, the speed differences in relation to the diameter D or D1 decrease. This means that the feeding speed of the lap layer 10 approaches with decreasing lap diameter D the speed at diameter D1 produced via friction.

Decisive for the feeding speed of the lap layer 10 is the winding off diameter D and the penetration depth X of the lap into the toothed lap arbour 4. From this results that the greater the difference betweens D and D1, or the indentation depth X, the greater the difference between the actual feeding speed of the lap layer 10 and the rotating speed produced in the area of the diameter D1. The conclusion from this consideration is that the feeding speed of the lap layer 10 at the beginning of the winding off process, i.e. with full lap roll, is greater than at the end of the winding off process.

Investigations have shown, however, that not only is the influence of the indentation depth of the lap with decreasing lap weight decisive for the changed feeding speed, but that also the changed dynamic interrelation between the feed roller drive and lap arbour drive play a role. Which one of these two criteria now is decisive for the forming drift depends on the given material and drive conditions.

Experiments have shown that these differences result in a drift of up to 5%.

For the combing process itself no disadvantages result, for between the lap roller 4 and the feed roller 18 a so-called tension draft is present which is greater than 1.0.

By way of the previously described drift keeping the count of the sliver formed following the combing aggregate at the comber cannot be guaranteed. This however is absolutely required in order to achieve an even thread at the following spinning processes. This however is to be guaranteed with the method proposed according to the invention, i.e. the created drift is compensated by the proposed method. The exemplary embodiment according to FIG. 1 shows a possible embodiment for realizing the method and is now more particularly described:

The lap roller 4 driven via the motor 8 puts the lap 3 into rotating movement via friction. The lap layer 10 wound off thereby is guided downward via the guide roller 11 and reaches into the action area of the feed roller 18. This feed roller 18 is driven intermittently by the movement of the upper nipper jaw via a ratchet drive (not shown) and conveys the lap layer 10 into the area of the nip of the nipper jaw 17. If the nipper jaw 17 is located in a rear position (not shown), then it is closed and a part of the lap layer 10, a so called fiber tuft, extends out of the closed nipper jaw 17 and is combed out by the combing segment 24 of the rotating comb cylinder 23. Subsequently, the nipper jaw 17 moves towards the front again and opens. Here the combed out fiber tuft is given off to the detaching roller pair 25 between which a tuft, which has already been combed out, is clamped. For reasons of simplicity the representation of an additional fixed comb which reaches from the top into the fiber tuft to be given off, as used conventionally, has been left out.

The drive of the detaching roller 25, of the comb cylinder 23 and of the driving roller for the nipper jaw 17 takes place from the central driving unit 26 which is controlled via the control 27. The control 27 and the control unit 9 are interconnected via a path 33 and can be harmonized to each other. This harmonization refers to the normal cooperation during the nipping of the comb, here a readjustment of the motor speed 8 due to a drift correction takes place independent of this cooperation. For determining the wound off length of the lap layer 10 the roller 12 which is spring weighted via a spring 34 is arranged on the guide roller 11, the lap layer 10 moving through these two. During supply of the lap layer 10, the feeler roller 12 is put into rotation, this rotational movement being detected via the impulse transmitter 13 or an incremental transducer. This rotational movement is converted into a corresponding signal via controller 15 and supplied to the control unit 9.

In the present example, a readjustment of the motor speed 8 and hence of the speed of the lap roller 4 takes place in temporary intervals in relation to the winding off length of the lap layer 10 determined by the feeler roller 12. The magnitude of the readjustment takes place in the shown example, as is visible in the diagram shown within the control unit, gradually, based on progressive ratios stored in the control unit 9. These preset adjustments of the speed based on wound off length units L of the lap layer 10 results from effected experiments and experimental values which have been determined.

Figure 4:
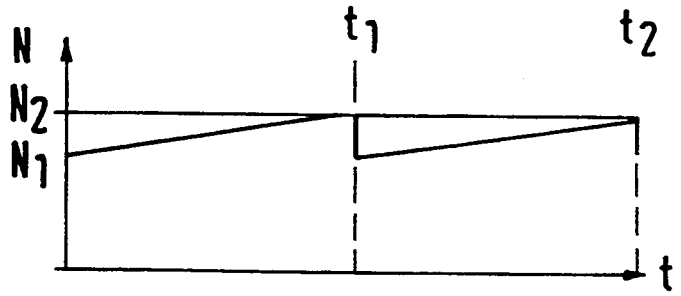
FIG. 4 shows a diagram for a possible speed adaption per wind-off interval of a lap roll.

It is, however, also possible to do without the feeler roller 12 and to adjust the speed of the motor 8 based on experimental values in a linear and continuous manner from the beginning of the winding off process (FIG. 4). This FIG. 4 also shows that the speed N1 of the motor 8 increases in a linear manner up to the change of the lap t1 to a value N2 and subsequently is guided back to the basic speed N1. The same linear increase takes place at the next winding off process up to the next lap change at T2.

It is also conceivable, as indicated in FIG. 2, to caliper the weight of the lap roll 3 via a balance 50 which carries the rear lap arbour 5 via a bearing bracket 49. According to the decreasing weight of the lap, the drive of the lap roller 4 can be controlled.

Figure 5:
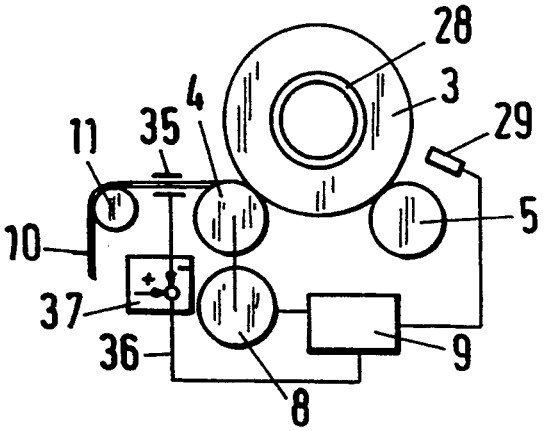
FIG. 5 shows a schematic partial view of a combing head according to FIG. 1 with a possible measuring organ for the lap.

FIG. 5 shows a further possibility which serves for controlling the lap roller drive. Here, following the lap arbour 4, the mass of the wound off lap layer 10 is measured via a capacitive measuring organ and compared with an actual value preset in a controller 37. With a drift forming in the course of the winding off process, the controller 37 emits a signal in case of a deviation from the set value via the path 36 to the control unit 9 which readjusts the motor 8. This way a closed control circuit is created and the motor 8, or the speed of the lap roller 4, is continuously readjusted when deviating from a set value.

Figure 3:
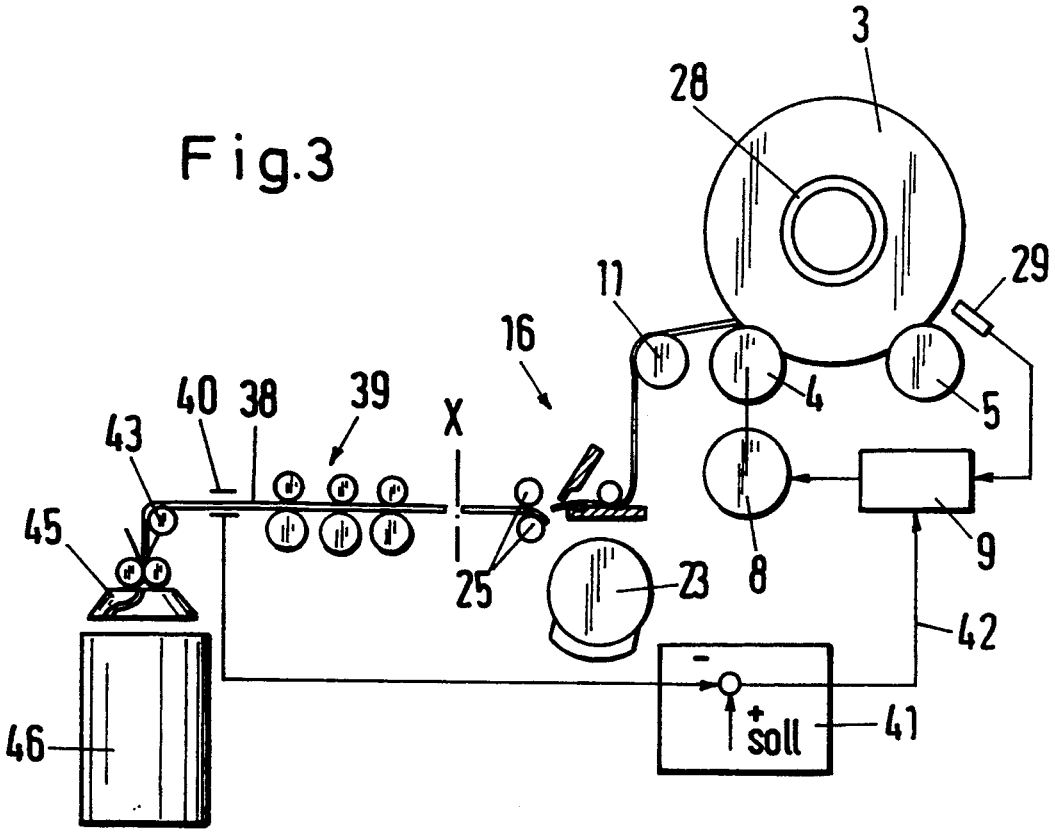
FIG. 3 shows a reduced view according to FIG. 1 with a schematically represented drafting arrangement and a layer coiling.

FIG. 3 shows a similar control unit according to FIG. 5. Here, however, there is a detection of an unevenness of a sliver 38 which has been formed by a drafting arrangement 39 which is downstream of the combing heads 16. For reasons of simplicity, the arrangement of the drafting arrangement and of the following devices have been turned by 90° around the axis X. The sliver 38 is monitored via the measuring organ 40 for its count, or the mass per unit of length. The signal created here is supplied to a controller 41 in which a comparison of the actual value and the set value is effected. If the actual value deviates from the set value, a control signal is transmitted to the control unit 9 via a path 42 for readjusting the motor 8. This is also a closed control circuit, however, readjustment taking place time-delayed. In this kind of adjustment, however, the influence of the comber-waste loss must be taken into account in order to avoid erroneous measurements.

The sliver 38 guided through the measuring organ 40 reaches a cone wheel 45, via a guide roller 43 and calender rolls, which can be driven in rotation, and which eventually places the sliver 38 in a can 46 for further conveyance to the following procedure steps.

In the exemplary embodiments of FIG. 1, 3, and 5 the lap is allocated a sensor 29 to monitor the finishing moment of the lap 3. This means, as soon as the white lap layer 10 has been wound off the black tube 28, the sensor 29 recognizes the black surface of the tube and transmits a signal to the control 9 for the motor 8 and to the control 27 for the control unit 26. This way, on the one hand the drive unit 26 is shut down via the control unit 27 as well as the drive 8 interrupted by the control unit 9. Simultaneously, with this interruption, the speed mark for the triggering of the motor 8 is reset to the basic speed N1 which comes into effect again with the beginning of the winding off process of a new lap. As previously already described, the basic speed N1 can be overriden until the beginning of the normal winding off process by using an automatic winding changer.

We claim:

1. A method of feeding a layer of lap from a lap roll comprising the steps of mounting a roll of lap on a pair of lap rollers;

driving at least one of said lap rollers in a direction to unwind a layer of lap from said lap roll during a winding-off interval; and increasing the speed of said one lap roller during said winding-off interval to maintain a constant thickness in the lap layer unwound from the lap roll.

2. A method as set forth in claim 1 which further comprises the steps of measuring the length of the lap layer unwound from the lap roll during said winding-off interval; and increasing the speed of said one lap roller in dependence on the measured length of the unwound lap layer increasing during said winding-off interval.

3. A method as set forth in claim 1 wherein said step of increasing the speed of said one lap roller is effected in one of a continuous manner and a step-wise manner.

4. A method as set forth in claim 1 which further comprises the steps of measuring the weight of the lap roll remaining on said lap rollers during said winding-off interval; and increasing the speed of said one lap roller in dependence on a decreasing measured weight of the lap roll.

5. A method as set forth in claim 1 which further comprises the steps of directing the layer of lap unwound from the lap roll to a combing unit of a comber for combing therein;

thereafter forming a sliver from the lap layer combed in the combing unit;

measuring the mass of the sliver downstream of the combing unit; and increasing the speed of said one lap roller in dependence on a change in the measured mass of the sliver during said winding-off interval.

6. A method as set forth in claim 1 which further comprises the steps of directing the layer of lap unwound from the lap roll to a combing unit of a comber;

measuring the mass of the lap layer directed to the combing unit; and increasing the speed of said one lap roller in dependence on a change in the measured mass of the lap layer during said winding-off interval.

7. A method as set forth in claim 1 which further comprises the steps of mounting a fresh lap roll on said rollers after unwinding of a previous lap roll therefrom; and automatically resetting the speed of said one lap roller from an increased speed level to a lower preset speed for initial unwinding of a lap layer from said fresh lap roll.

8. A method as set forth in claim 1 which further comprises the steps of directing the layer of lap unwound from the lap roll to a combing unit of a comber;

driving the comber independently of the speed of said one lap roller; and increasing the speed of said one lap roller independently of the operation of the comber.

9. A method of feeding a layer of lap from a lap roll comprising the steps of mounting a roll of lap on a pair of lap rollers with one of said rollers forming an indentation in said roll of lap;

driving at least said one lap roller in a direction to unwind a layer of lap from said lap roll during a winding-off interval; and increasing the speed of said one lap roller during said winding-off interval to compensate for a change in lap unwinding speed due to said indentation and to maintain a constant thickness in the lap layer unwound from the lap roll.

10. A method as set forth in claim 9 which further comprises the steps of directing the layer of lap unwound from the lap roll to a combing unit of a comber;

driving the comber independently of the speed of said one lap roller; and increasing the speed of said one lap roller independently of the operation of the comber during said winding-off interval.

* * * * *